United States Patent [19]

Shiffer

[11] Patent Number: 4,518,185

[45] Date of Patent: May 21, 1985

[54] DIE HANDLING DEVICE

[75] Inventor: Robert J. Shiffer, Smithfield Township, Monroe County, Pa.

[73] Assignee: McGraw-Edison Company, Rolling Meadows, Ill.

[21] Appl. No.: 533,232

[22] Filed: Sep. 19, 1983

[51] Int. Cl.[3] ..... B66C 1/16

[52] U.S. Cl. ..... 294/67.1; 294/82.11

[58] Field of Search ..... 294/67 R, 67 B, 67 BB, 294/67 D, 67 DA, 67 DB, 67 E, 74, 78 R, 78 A, 81 R, 82 R, 83 R, 83 AA, 86 R, 89, 93

[56] References Cited

U.S. PATENT DOCUMENTS

| | | | |
|---|---|---|---|
| 859,513 | 7/1907 | Paige | 294/67 BA X |
| 1,556,645 | 10/1925 | Stoney et al. | 294/81 R X |
| 1,603,421 | 10/1926 | Shaffer | 294/67 E X |
| 1,734,176 | 11/1929 | McCabe | 294/67 R UX |
| 1,768,484 | 6/1930 | Lotts | 294/74 |
| 1,774,623 | 9/1930 | Williams | 294/81 R |
| 2,472,843 | 6/1949 | Muise | 294/67 R |
| 2,965,408 | 12/1960 | Edwards | 294/78 R X |
| 3,015,407 | 1/1962 | Fesmire et al. | 294/81 SF X |
| 3,502,205 | 3/1970 | Milton | 294/67 E X |
| 3,502,364 | 3/1970 | Moore | 294/67 R |
| 4,010,971 | 3/1977 | Kuwamoto et al. | 294/81 R |

*Primary Examiner*—Johnny D. Cherry

*Attorney, Agent, or Firm*—Donald J. Breh; Charles W. MacKinnon; Jon Carl Gealow

[57] ABSTRACT

A die handling device for lifting and moving die sets includes a pair of clamps for holding a die shoe of the die set. Each clamp includes a body with first and second parallel extensions. Each extension includes an aperture. A portion of a die shoe is positioned between the parallel extensions. An aperture is fabricated in the die shoe and once aligned with the apertures in the first and second parallel extensions, a pin is inserted through the apertures. The pin is locked in place by a snap lock. The lock includes a transverse bore through the pin with a ball partially mounted in a first end of the bore and a set screw mounted in a second end. A resilient plug or spring is positioned within the bore between the ball and set screw. A second die shoe may be held by a second pair of clamps identical to the first pair. The first pair and second pair of clamps are joined by an adjustable link that includes first and second identical members. Each member includes a plurality of apertures. The position of the two members relative to each other may be varied to vary the distance between the first and second clamps. Once the proper length of the link is attained, one or more fasteners are inserted through aligned apertures joining the two members together. The ends of the members are then secured to the clamps.

5 Claims, 6 Drawing Figures

FIG. 1
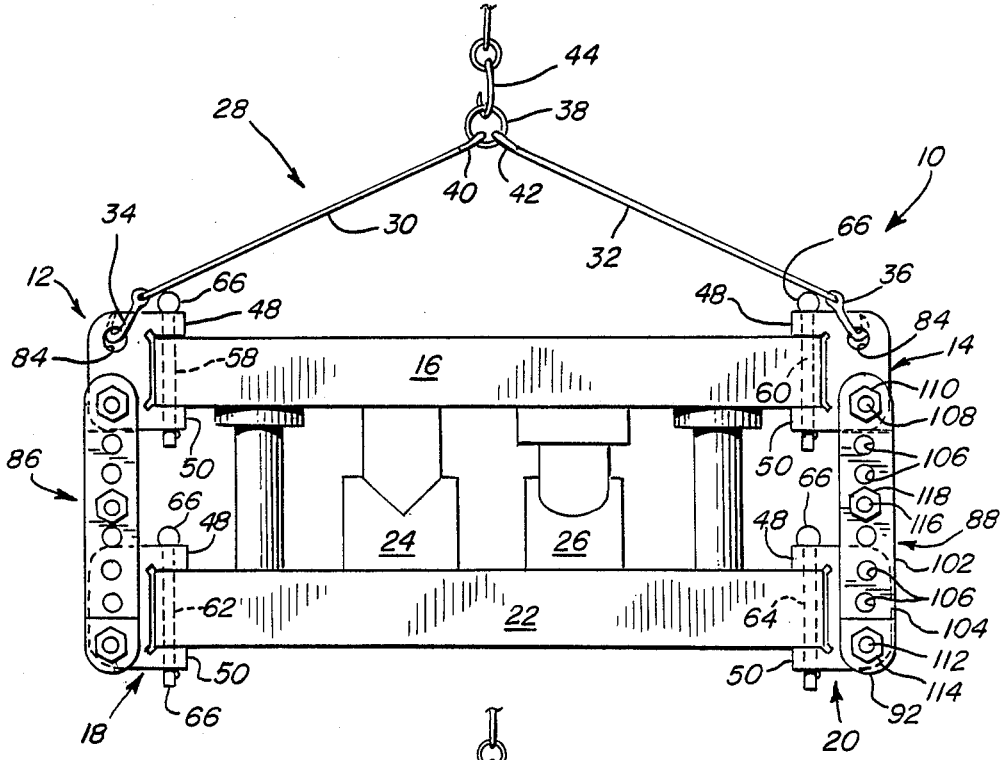
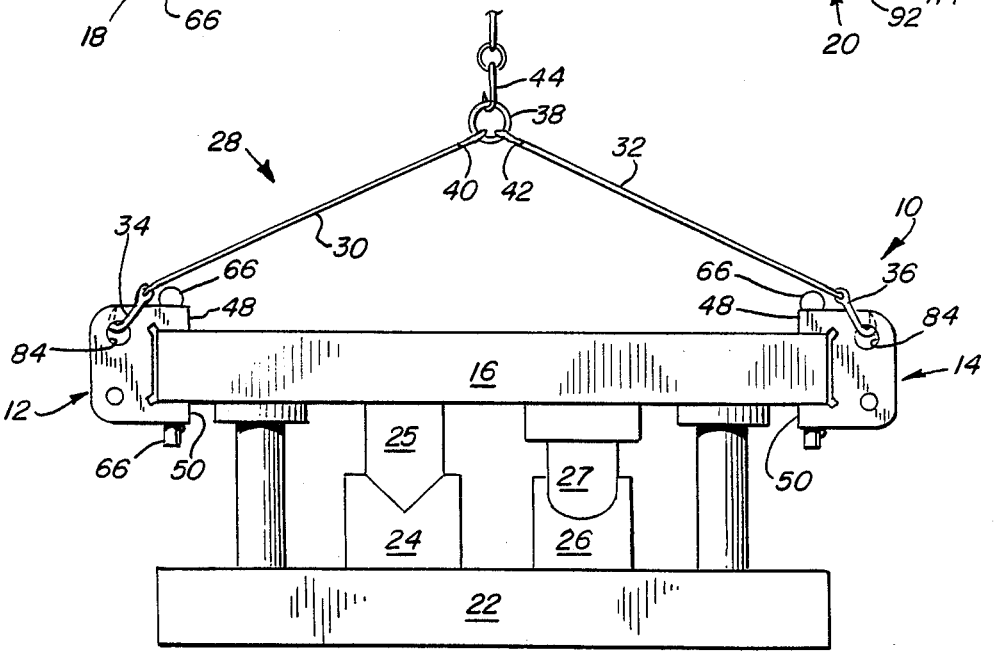
FIG. 2

FIG. 3
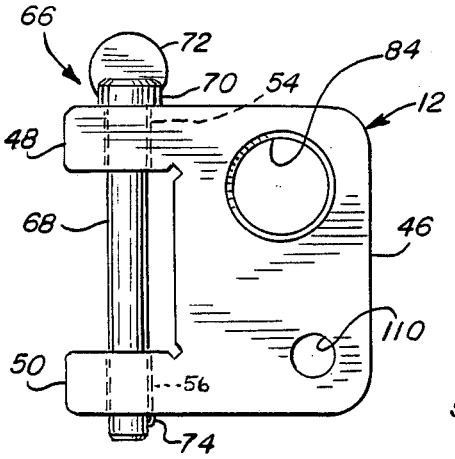
FIG. 4
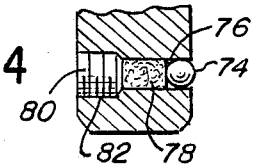
FIG. 6
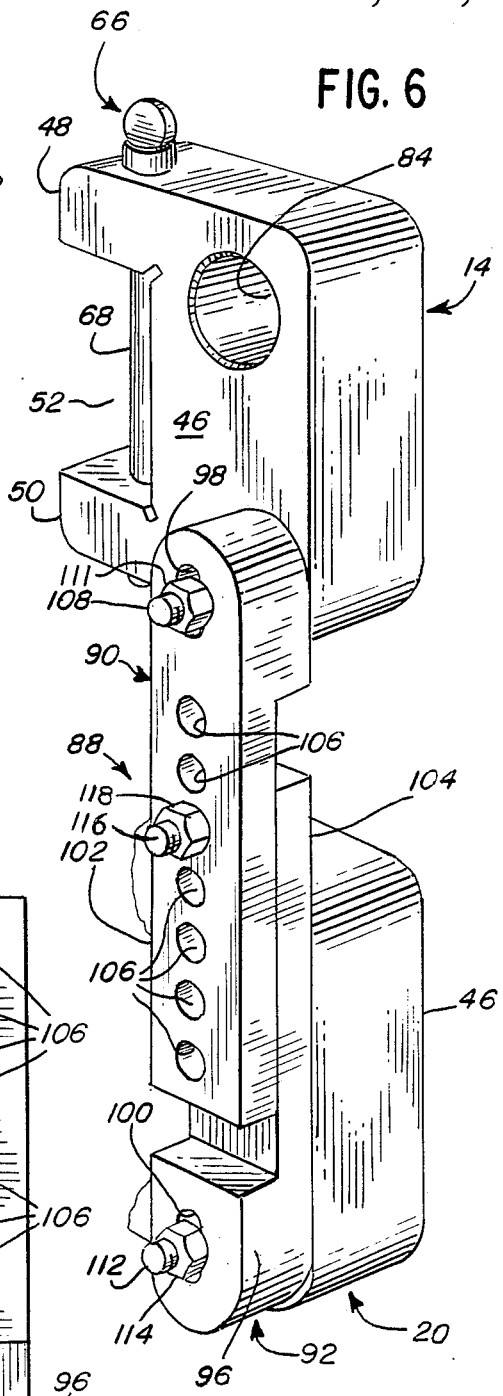
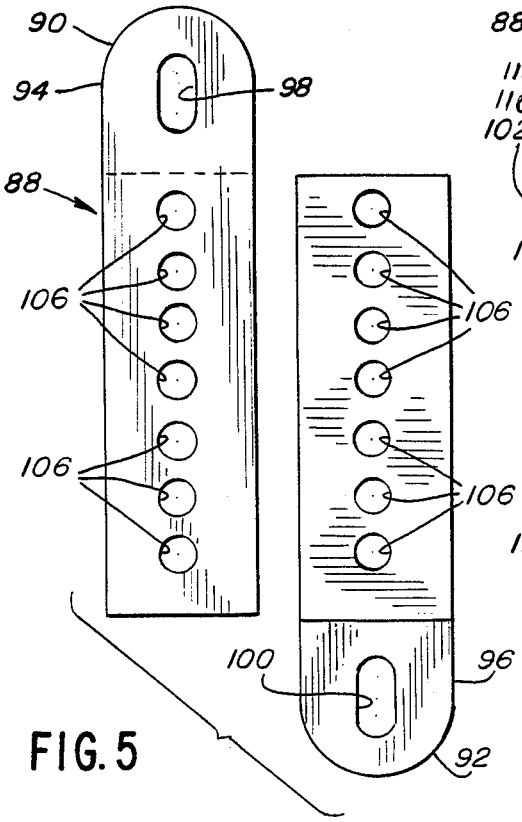
FIG. 5

DIE HANDLING DEVICE

BACKGROUND OF INVENTION

The present invention relates to a new and improved device for handling dies and more particularly, to a new and improved die handling device that includes a clamp securely fastened to a die and an adjustable link joining a plurality of clamps and dies.

In lifting heavy tools such as dies, a crane and sling is often used for lifting the tools from one location to another or separating the tools. Typically, C-clamps have been attached to the top and bottom die shoes of a die and the crane attached to the C-clamps. Such a procedure is dangerous since C-clamps have a tendency to slip.

To overcome these dangers other securement devices have been developed. In U.S. Pat. No. 1,774,623, a sling and clamp for lifting and transporting articles is disclosed. The assembly in U.S. Pat. No. 1,774,623 only carries a single plate or item. The clamp in U.S. Pat. No. 1,774,623 is complex with a large number of parts and employs a screw to hold the member being transported. This method of securement is similar to a C-clamp and could result in a safety hazard.

A apparatus for transporting a plurality of devices is illustrated in U.S. Pat. No. 2,965,408. The clamp disclosed in this patent is complex with a plurality of components and pins that hold a member such as an I-beam between two surfaces. This device is also susceptible to loosing hold of the beam or other item transported.

A device for lifting molds is disclosed in U.S. Pat. No. 1,734,176. This device lifts and transports only a single mold on a platform.

A carrier for carrying a plurality of items is disclosed in U.S. Pat. No. 2,472,843. This device merely includes a plurality of bars on which items are positioned. The items are not securely attached to the carrier and could shift or slide off the end.

A complicated clamp for securing a sling to stacked cargo containers is illustrated in U.S. Pat. No. 3,015,407. This device includes a hook structure that can be loosened from a device being carried resulting in a safety hazard.

Sling type arrangements for carrying and transporting containers that are loosely stacked on a platform are illustrated in U.S. Pat. Nos. 3,502,205 and 3,502,364.

SUMMARY OF THE INVENTION

An object of the present invention is to provide a new and improved handling device.

Another object of the present invention is to provide a new and improved die handling device that is securely attached to a die to allow safe transportation and lifting.

A further object of the present invention is to provide a new and improved die handling device including a clamp that may be secured to a die shoe by a pin allowing safe transportation and lifting.

A still further object of the present invention is to provide a new and improvement die handling device that includes a plurality of clamps and adjustable links securing the clamps to allow a plurality of die shoes to be transported.

Briefly, the present invention is directed to a new and improved die handling device for safely lifting and transporting dies. The die handling device includes a clamp having a body and parallel extensions. Each extension includes an aperture. An edge of a die shoe is positioned between the parallel extensions. The die shoe includes an aperture aligned with the apertures in the parallel extensions and a pin is extended through the aligned apertures.

The pin includes a snap lock defined by a transverse passage in which is mounted a set screw and a steel ball. A spring or resilient plug is positioned between the set screw and the steel ball.

A second die shoe may be transported by attaching an identical clamp to the second die shoe and joining the two clamps by adjustable links. Each adjustable link includes two identical members each with a plurality of apertures. At least one fastener is passed through aligned apertures in the link members thereby joining the link members. Each link member is joined to the clamps by a fastener. A sling is attached to one of the clamps and a crane is secured to the sling which lifts the die. The above and other objects and advantages and novel features of the present invention will become apparent from the following detailed description of a preferred embodiment of the invention, illustrated in the accompanying drawings.

BRIEF DESCRIPTION OF THE DRAWINGS

FIG. 1 is an elevational view of a die handling device constructed in accordance with the principles of the present invention;

FIG. 2 is an elevational view of the die handling device of the present invention modified for lifting a top die shoe;

FIG. 3 is a plan view of a clamp used in the present invention;

FIG. 4 is a partial, cross-sectional view of the lower portion of a pin used in the clamp illustrated in FIG. 3;

FIG. 5 is a plan view of the members of an adjustable link used in the present invention; and FIG. 6 is a perspective view of a link and clamp assembly.

DETAILED DESCRIPTION OF THE PREFERRED EMBODIMENT

Referring now to the drawings and initially to FIG. 1, there is illustrated a die handling device generally designated by the reference numeral 10. Die handling device 10 includes a first clamp assembly generally designated by the reference numeral 12 and a second clamp assembly generally designated by the reference numeral 14. Clamp assemblies 12 and 14 secure and hold a top die shoe 16. Similarly, clamp assemblies generally designated by reference numerals 18 and 20 are secured to a bottom or lower die shoe 22. Die shoes 16 and 22 hold a tool including dies 24 and 26.

Die handling device 10 lifts and transports the tool held by die shoes 16 and 22 through the employment of a sling generally designated by the reference numeral 28. Sling 28 includes cables 30 and 32 and hooks 34 and 36. Cables 30 and 32 are secured to a ring 38 by eyelets 40 and 42. Ring 38 is connected to a hook 44 which is part of a crane.

Die handling device 10 may be employed to lift the entire tool or to separate top die shoe 16 from bottom die shoe 22, as illustrated in FIG. 2. During either lifting or separating, it is desirable to connect sling 28 securely to clamps 12 and 14 and to ensure that clamps 12 and 14 are firmly secured to die shoes 16 and 22. Since clamps 12, 14, 18 and 20 are identical, the discussion will be of clamp 12 with the understanding the remaining clamps 14, 18, 20 include identical components.

Clamp 12 (FIG. 3) includes a body 46 of a generally C-shaped configuration with outwardly extending arms or extensions 48 and 50. A recess 52 is defined between extensions 48 and 50. Upper extension 48 includes a bore or passage 54. Similarly, lower extension 50 includes a bore or passage 56 in alignment with bore 54. Die shoes 16 and 22 include passages 58, 60, 62 and 64, respectively, to be aligned with the passages 54 and 56. To secure clamp 12 to top die shoe 16, an edge of die shoe 16 is positioned within recess 52 with bore 58 aligned with bores 54 and 56.

A lock pin, generally designated by the reference numeral 66, is inserted through the aligned bores 54, 56 and 58 thereby attaching clamp 12 to top die shoe 16. Pin 66 includes an elongated body 68 with a head 70 at an upper end larger in diameter than bore 54. Head 70 prevents lock pin 66 from passing completely through aligned passages 54, 56 and 58. Lock pin 66 also includes a tab or ring 72 allowing an operator to grasp tab 72 to remove lock pin 66 from aligned bores 54, 56 and 58.

Lock pin 66 includes a snap lock provided by a steel ball 74 partially extending outward from body 68 to engage clamp body 46 below bore 56 (FIG. 3). Steel ball 74 is resiliently biased outward of a transverse bore 76 fabricated in body 68. Biasing is accomplished by a spring or a resilient plug 78, that may be of any material such as, for example, polyurethrene. Ball 74 and spring or plug 78 are maintained in position by a set screw 80 threaded into an enlarged portion 82 of bore 76. Upon removal of the set screw 76, springer plug 78 and ball 74 may be replaced or repaired. Ball 74 provides a locking force greater than that provided by a frictional fit to allow sure locking of pin 66 within clamp 12.

Once clamp 12 has been secured to die shoe 16, sling 28 is secured to clamp 12 by placing hook 34 through an aperture 84 in clamp body 46. Clamp 14 is secured to die shoe 6 and sling 28 in a similar manner. Crane hook 44 may then lift die shoe 16 from die shoe 22 with ease and safety.

Clamps 12, 14, 18 and 20 may be of various sizes depending on the size and weight of the items to be lifted. Clamp pins 66 may also be varied in size in accordance with the size of the clamp.

If the entire tool defined and held by top die shoe 16 and bottom die shoe 22 is to be lifted and transported, clamp assemblies 12 and 18 and clamp assemblies 14 and 20 are linked together by adjustable links generally designated by the reference numerals 86 and 88. Links 86 and 88 will be described with the understanding that the components of link 88 are identical to those of link 86.

Adjustable link 88 includes a first link member 90 and a second link member 92 which are identical in configuration and structure (FIG. 5). Link member 90 includes an upper enlarged portion 94 and link member 92 includes a similar portion 96. Enlarged portions 94 and 96 include slots 98 and 100, respectively. Each link member 90 and 92 includes a lower, thinner portion 102 and 104, respectively, in which are fabricated a plurality of spaced apertures 106.

To join clamps 14 and 20, members 90 and 92 are placed together with enlarged portion 94 at one end of the joined link 88 and the enlarged portion 96 at the other end (FIG. 6). Fastener 108 is passed through an aperture 110 (FIG. 3) defined in body 46 of clamp 14, through slot 98 and secured by a nut 111. Similarly, a fastener 112 is passed through aperture 110 of clamp 20, through slot 100 in link 92 and secured by a nut 114. A third fastener 116 is passed through a pair of aligned apertures 106 in link members 90 and 92 and secured by a nut 118.

Adjustable link 88 is assembled and rigidly secured to clamps 14 and 20 and link 86 is assembled in a similar fashion and rigidly secured to clamps 12 and 18. It will be understood that additional clamps may be employed if additional dies are to be joined. Handling of the complete tool by the scane hook 44, as illustrated in FIG. 1, provides an easily assembled device 10 that securely holds the entire tool to avoid a safety hazard.

I claim:

1. A device for lifting as an assembly a die set of the type having separable upper and lower die shoes disposed in vertically spaced apart relationship comprising:

a first pair of clamps each including means for removably engaging one end of each of said upper and lower die shoes;

a first adjustable in length link connecting said first pair of clamps in vertically spaced apart relationship;

a second pair of clamps each including means for removably engaging an end of each of said upper and lower die shoes opposite to said one end;

a second adjustable in length link connecting said second pair of clamps in vertically spaced apart relationship; and a sling connected between an uppermost one of said first pair of clamps and an uppermost one of said second pair of clamps.

2. The device set forth in claim 1, further comprising a first aperture in each of said uppermost ones of said clamps for securement of said sling.

3. The device set forth in claim 2, wherein said first and second adjustable links each include a first link body and a second link body, said first and second link bodies being identical and including a plurality of apertures, each said clamp including a second aperture, a first fastener positioned in said second aperture in each said clamp and in one aperture of said plurality of apertures in each link body to couple said adjustable links to said clamps, and a second fastener in another aperture of said plurality of apertures in each link body to couple said first and second link bodies and said pairs of clamps together.

4. The device set forth in claim 1, wherein said clamps are removably secured to said upper and lower die shoes with a locking pin including:

a transverse passage in said pin;

a ball in a first end of said transverse passage;

a set screw in a second end of said transverse passage; and a resilient member in said transverse passage between said set screw and said ball.

5. The device set forth in claim 4, wherein each of said clamps includes a body including a pair of parallel spaced apart extensions each including an aperture aligned with a hole provided in each of said upper and lower die shoes adjacent said one end and said opposite ends thereof, when said clamps are engaged to said upper and lower die shoes, and said locking pin extends through said aperture in said extensions and said hole in said upper and lower die shoes.

* * * * *